US011141001B2

(12) United States Patent
Järvinen et al.

(10) Patent No.: US 11,141,001 B2
(45) Date of Patent: Oct. 12, 2021

(54) RECIPROCATION DEVICE AND CRIB

(71) Applicant: Familings Oy, Helsinki (FI)

(72) Inventors: Teemu Järvinen, Helsinki (FI); Markus Vihottula, Helsinki (FI); Riitta Sissala, Helsinki (FI); Pekka Salmi, Helsinki (FI); Hanna Sissala, Helsinki (FI); Ismo Viitaniemi, Helsinki (FI)

(73) Assignee: FAMILINGS OY, Helsinki (FI)

( * ) Notice: Subject to any disclaimer, the term of this patent is extended or adjusted under 35 U.S.C. 154(b) by 578 days.

(21) Appl. No.: 15/741,769

(22) PCT Filed: Jul. 19, 2016

(86) PCT No.: PCT/FI2016/050534

§ 371 (c)(1),
(2) Date: Jan. 4, 2018

(87) PCT Pub. No.: WO2017/017311

PCT Pub. Date: Feb. 2, 2017

(65) Prior Publication Data

US 2018/0192787 A1 Jul. 12, 2018

(30) Foreign Application Priority Data

Jul. 24, 2015 (GB) ..... 1513121

(51) Int. Cl.
*A47D 9/02* (2006.01)
*A47C 21/00* (2006.01)

(52) U.S. Cl.
CPC ..... *A47D 9/02* (2013.01); *A47C 21/006* (2013.01)

(58) Field of Classification Search
CPC ..... A47C 23/18; A47C 23/24; A47C 23/28; A47C 7/462; A47C 21/006; A47D 9/02; A61G 7/0573
See application file for complete search history.

(56) References Cited

U.S. PATENT DOCUMENTS 3,126,553 A * 3/1964 Zastera ..... A47C 23/24 5/233
4,459,712 A * 7/1984 Pathan ..... A61G 7/001 5/81.1 C (Continued)

FOREIGN PATENT DOCUMENTS

| | | |
|---|---|---|
| CA | 2688904 | 6/2011 |
| GB | 1009787 | 11/1965 |
| GB | 2045603 | 11/1980 |

*Primary Examiner* — David R Hare
*Assistant Examiner* — Alexis Felix Lopez
(74) *Attorney, Agent, or Firm* — Jacob Eisenberg

(57) ABSTRACT

An alternative solution for pacifying an infant in his own bed or cradle is herein disclosed. The solution is based on a novel reciprocation device that has a membrane, which supports at least one being and extends along a first Cartesian dimension (Y) and a second Cartesian dimension (Z) to cover an area and has a thickness in the third Cartesian dimension (X). The reciprocation device also includes a tensioning mechanism, which is attached to the membrane and adjusts the tension of the membrane in at least either first or second Cartesian dimension (Y, Z) for repeatedly reciprocating the at least one being lying on the membrane.

24 Claims, 8 Drawing Sheets

(56) References Cited

U.S. PATENT DOCUMENTS

| | | | | |
|---|---|---|---|---|
| 5,058,952 | A * | 10/1991 | LaSota | A47C 7/28 297/284.2 |
| 5,107,555 | A * | 4/1992 | Thrasher | A47D 9/02 5/107 |
| 6,022,277 | A * | 2/2000 | Jankowski | A47D 13/105 472/119 |
| 7,467,426 | B1 * | 12/2008 | Jarmon | A47C 23/28 5/191 |
| 8,210,612 | B2 * | 7/2012 | Adams | A47C 7/462 297/284.4 |
| 8,578,530 | B2 * | 11/2013 | Patwardhan | A61G 7/0514 5/604 |
| 2007/0067908 | A1 * | 3/2007 | Gudipati | A47D 13/10 5/109 |
| 2012/0068510 | A1 * | 3/2012 | Chen | A61G 7/0573 297/311 |
| 2013/0160208 | A1 | 6/2013 | Davenport et al. | |
| 2014/0103687 | A1 * | 4/2014 | Carlson | A47C 7/32 297/284.1 |
| 2014/0250592 | A1 * | 9/2014 | Karp | A47D 9/02 5/108 |
| 2015/0305517 | A1 * | 10/2015 | Koch | A47C 20/041 700/275 |

* cited by examiner

RECIPROCATION DEVICE AND CRIB

FIELD

The present invention relates to the field of sleeping devices. In particular, the invention relates to pacifying sleeping accessories for infants. More precisely, the invention relates to a reciprocation device according to the preamble portion of claim 1 and to a crib.

BACKGROUND

It is a known problem to sooth an infant to the state of relaxation required for an infant to fall asleep. While it may be possible to pacify the baby by rocking him in one's arms, some babies require said soothing motions for extended periods of time. Considering that babies have a tendency to wake up repeatedly during the night, there is a need for device assisting parents in pacifying the child with aid of reciprocating motion.

There are numerous accessories in the market for assisting the process. EP 1898753 B1 and U.S. Pat. No. 5,107,555 A, for example, disclose mechanisms for rocking the mattress of a cradle so as to create a soothing motion. These mechanisms include actuators, which are configured to lift and lower corners of the mattress in a specific sequence. The actuators may be mechanical or pneumatic.

It is an aim of the present invention to provide an alternative solution for pacifying an infant in his own bed or cradle.

SUMMARY OF THE INVENTION

The aim is achieved with a novel reciprocation device, which is constructed as a retro-fit module, which is dimensioned to replace or be placed under the mattress of a crib. The reciprocation device has a membrane, which supports at least one being and extends along a first Cartesian dimension and a second Cartesian dimension to cover an area and has a thickness in the third Cartesian dimension. The reciprocation device also includes a tensioning mechanism, which is attached to the membrane and adjusts the tension of the membrane in at least either first or second Cartesian dimension for repeatedly reciprocating the at least one being lying on the membrane.

On the other hand the aim is achieved with aid of a crib having a reciprocation device with a membrane for supporting at least one being, with an extension along a first Cartesian dimension and a second Cartesian dimension to cover an area and with a thickness in the third Cartesian dimension. The reciprocation device also has a tensioning mechanism attached to the membrane for repeatedly adjusting the tension of the membrane in at least either first or second Cartesian dimension for repeatedly reciprocating the at least one being supported by the membrane.

The invention is defined by the features of the independent claim. Specific embodiments are defined in the dependent claims.

EMBODIMENTS

In the present context, the term "length of the membrane" means the length of the membrane measured along the outer surface of the membrane. The term is not meant as the length of the object when seen from a perspective.

In the present context, the term "span length of the first and second longitudinal member" means the shortest distance between the longitudinal center axes of the first and second longitudinal member.

In the present context, the term "membrane" includes but is not limited to sheet-like members, which are able to be tensioned and loosened to create sag and which are also able to withstand the weight of a being, particularly an infant.

It is to be understood that the expression "rotation" does not in the present context necessitate a complete revolution about an axis. Instead, the term "rotation" should be understood as an angular displacement from an original state including rotation not completing a full round.

As will be explained in greater detail here after, the inventive concept is based on supporting the being, particularly an infant, on a membrane, the tension of which is toggled between a loose and tight state. The amplitude of the fluctuating motion measured from the center of the membrane may be about 10 to 150 mm, particularly about 120 mm. Amplitude in this context means the height difference between the topmost height and the bottom most height of the membrane or the height difference between the bottom most height and rest height—in which case the length is half of the above-stated—measured from the center thereof. Alternatively, the amplitude may mean the vertical travel of the center of the membrane. The membrane may be a part of a module, which is dimensioned to replace a mattress of a crib, whereby the reciprocation device may be retrofitted to any crib for assisting the infant to fall asleep without parental involvement. Alternatively the reciprocation device may be integrated into a bed or crib, wherein the infant or other being may lie directly on top of the membrane of the reciprocation device or via an intermediate layer, such as a mattress. In such integrated constructions, the reciprocation device may replace the bottom of the crib or bed.

Figure 1:
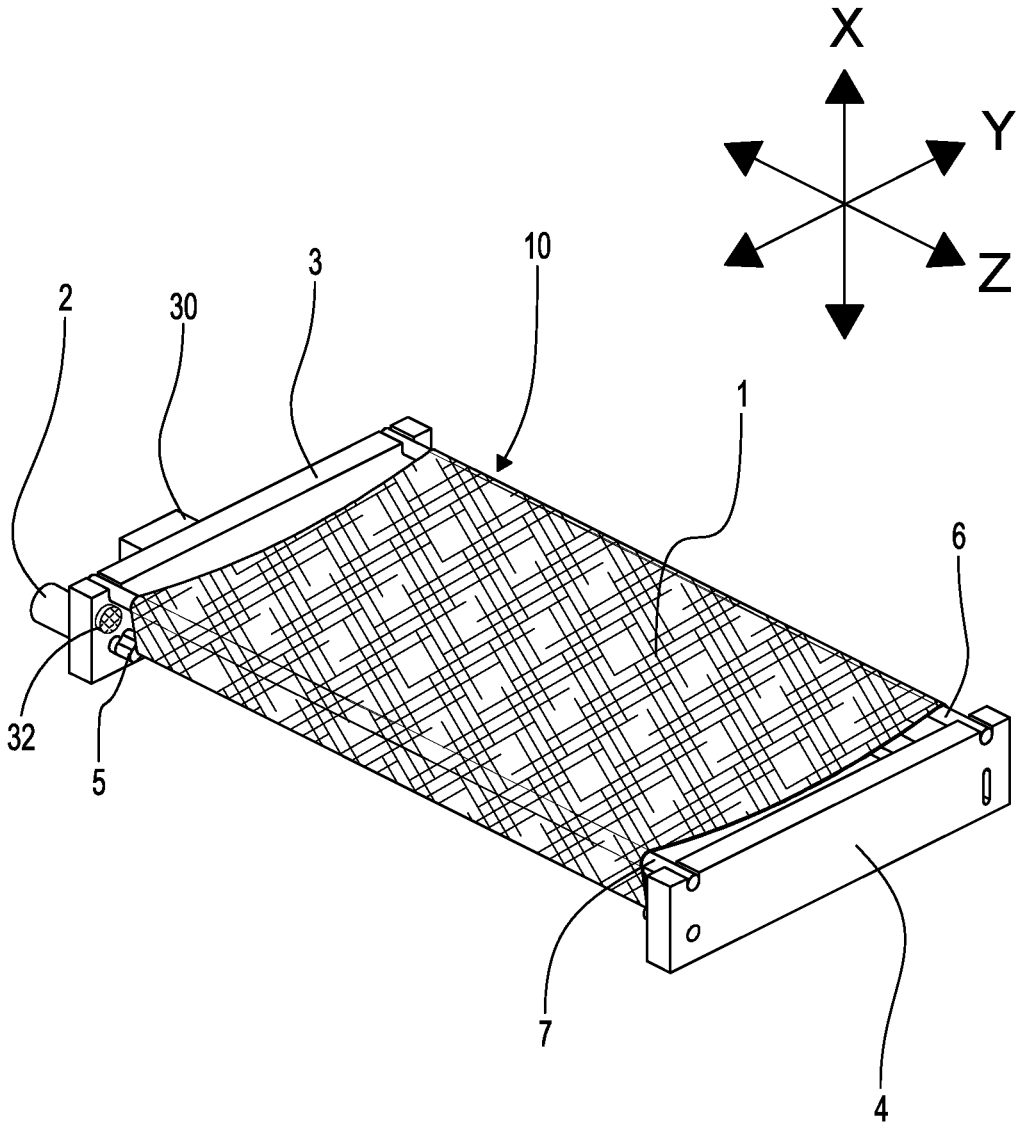
FIG. 1 illustrates an isometric view of a reciprocation device in accordance with at least some embodiments of the present invention.

As illustrated by FIG. 1, the reciprocation device 10 has a membrane 1 for suspending the infant between support structures, which may vary. The membrane 1 is a sheet-like member which made from a supple material capable of repeatedly undergoing deformations, namely buckling. It is preferable to manufacture the membrane 1 from a fabric, which is permeable to air for maintaining air supply to the infant sleeping face down. More preferably, the membrane 1 is made from a fabric mesh to amplify the effect. A mesh has the added benefit of keeping the infant cool. The membrane 1 covers an area, which is suitable for receiving and supporting an infant. However, also larger membranes 1 are possible to be used for assisting larger beings to sleep, such as grown humans or even large mammals. In the framework illustrated by FIG. 1, the membrane 1 extends over the first Cartesian dimension Y and second Cartesian dimension Z to cover the area. Respectively, the membrane 1 has its thickness in the third Cartesian direction X.

In the illustrated example, the membrane 1 is supported in a modular structure, which is constructed as a retro-fit module, which is dimensioned to replace the mattress of a crib. Alternatively, the reciprocation mechanism 10 could be constructed as an integral part of a bed, crib or any device intended for sleeping. In the shown embodiment, the module includes two longitudinal body parts, namely the first longitudinal body part 6 and the second longitudinal body part 7, extending in the second Cartesian dimension Z for supporting the membrane 1 and its load. The module also includes two transversal body parts, namely the first transversal body part 3 and the second transversal body part 4, extending in the first Cartesian body part Y for connecting the longitudinal body parts 6, 7 at a distance. The first and second transversal body parts 3, 4 may be blocks, as shown, for supporting the first and second longitudinal body part 6, 7. The first and second longitudinal body parts 6, 7, on the other hand, are rotatable rods, which are bearing mounted to the first and second body parts 3, 4 so as to minimize abrasion between the membrane 1 and the first and second longitudinal body parts 6, 7. The body parts 3, 4, 6, 7 form the frame of the reciprocation device (10) for acting as a mounting point for accessories including the drive 2. In the illustrated example the transversal body parts 3, 4 is used as a chassis.

According to a particular embodiment, some or all of the body parts may be provided with joints (not shown) permitting the transversal body parts to be folded. Preferably the folding would turn the hinged parts of the body parts into a straight angle or near a straight angle so as to fold device to fit into a smaller volume during transport, for example.

Figure 2:
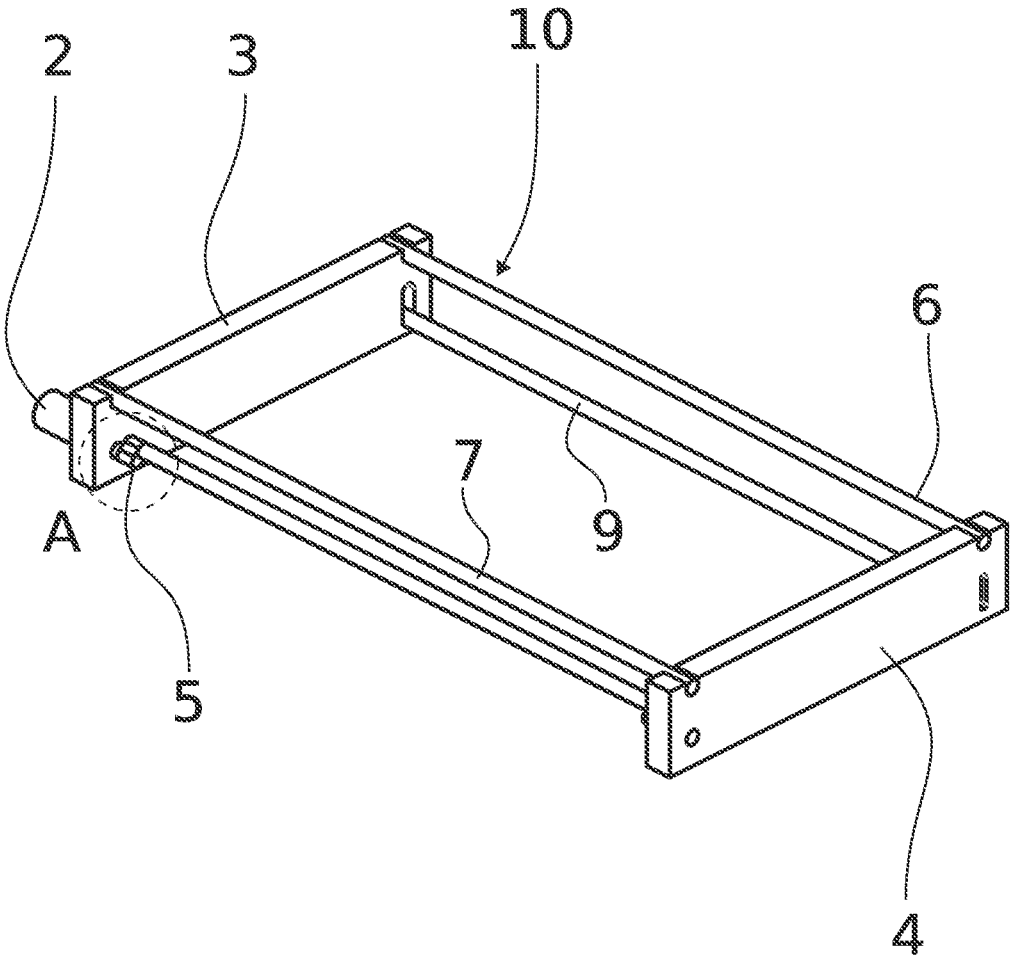
FIG. 2 illustrates the device of FIG. 1 without a membrane.

Turning now to FIG. 2, which shows the reciprocation device 10 without the membrane 1 for illustrating the support structure of the reciprocation device more clearly. The shown example represents a variant, which provides fluctuating motion to the membrane from one side only. Such a movement will result in the being lying on the membrane to be moved up and down in an asymmetric fashion, whereby the being is slightly rocked from one side to the other. Adjusting the tension of the membrane from two sides is addressed separately without reference to any FIGURES.

FIG. 2, however, shows that the transversal body parts 3, 4 support the first and second longitudinal body part elevated in the third Cartesian direction from the platform on which the device is installed. The transversal body parts 3, 4 therefore bear the load of the being on the membrane through the longitudinal body parts 6, 7.

As is also visible from FIG. 2, the reciprocation device also includes a third longitudinal body part 9, which is arranged to run parallel to and lower than the first longitudinal body part 6. In other words, the third longitudinal body part 9 deviated from the second longitudinal body part 6 in the third Cartesian dimension X. An adjustment mechanism is provided to adjust the position of the third longitudinal body part 9 in the third Cartesian dimension X. The adjustment mechanism may be provided simply by arranging vertical slots and locking means (not shown) to the first and second transversal body parts 3, 4. The vertical adjustment is used for pre-setting the tension of the membrane 1, which is connected at one end to the third longitudinal body part 9. The vertical adjustment also serves to facilitate assembly and disassembly of the device. By loosening the membrane 1 through the vertical adjustment of the third longitudinal body part 9 the membrane 1 may be easily removed for washing, replacing, etc.

In addition to or instead of being adjustable in the third Cartesian dimension X, the third longitudinal body part may also be rotatable similar to the tension mechanism (not shown). In other words, the longitudinal body part may be constructed as a rotatable eccentric axle.

The reciprocation device 10 also includes a tensioning mechanism, which may be provided in numerous different ways. In the FIGURES the tension mechanism 5 is shown as a rotatable eccentric axle, but also different non-illustrated examples are possible. The alternative constructions are explained here after. The embodiment shown in FIG. 2 in shown in greater detail in FIG. 3, which reveals that the tensioning mechanism 5 includes an axle 51, which is supported by the first transversal body part 3 and driven by a drive 2 also supported by the first transversal body part 3. The axle 51 therefore extends through the first transversal body part 3 and terminates to the drive 2. The drive may be an electric, geared motor, linear actuator, a step motor or any other controllable means for providing reciprocation of one end of the membrane 1. It is preferable that the drive is able to produce at least 5 Nm of torque. A low-voltage DC motor would be suitable for the purpose due to quietness and controllability. The axle 51 is connected to a rod 53 through an eccentric member 52, i.e. a radial arm. The eccentric member 52 is intended to provide a radial deviation from the axle 51 for providing reciprocity at one end of the membrane 1 so as to repeatedly adjust the tension of the membrane 1 between the loose and tight state. Another similar connection is provided to the opposite end of the rod 53, whereby the opposite end of the rod 53 is connected to the second transversal body part 4, through an eccentric member and an axle (not shown).

The purpose of the construction is to provide a rotatable eccentric axle, which runs in the second Cartesian dimension Z parallel to the second longitudinal body part 7. Instead of an axle, eccentric member and rod, the eccentric axle could also be provided as a cam-like axle. The illustrated example is, however, preferred for its lightness and the possibility to provide a tensioning mechanism with an adjustable tensioning profile. Indeed according to a further embodiment (not shown), the length of the eccentric member 52 is adjustable, by means of a telescopic arm, for example, for adjusting the amplitude of the fluctuating movement of the membrane 1 between the loose and tight state. The rod 53 runs parallel to the second longitudinal body part 7 in the second Cartesian dimension Z between the eccentric member 52 and the second transversal body part 4. The other end of the membrane 1 is attached to the rod 53 preferably through a quick coupling, such as a zipper or other type of form fitting couplings for fabric.

The drive 2 is arranged to rotate the eccentric member composed of the axles 51, eccentric members 52 and rod 53 in two opposite directions so as to manipulate the membrane 1 between the loose and tight state. While complete rounds of rotation are possible, they are not necessary for establishing reciprocity at the end of the membrane 1 connected to the rod 53. The drive 2 is controlled by a controller (not shown), which acts as an interface between the user and the reciprocation device 10. The primary function of the controller is to control the drive 2 to rotate back and forth.

The controller may also include a motion-induced start function for starting the drive 2, when the reciprocation device 10 detects that the being is moving. The purpose of such a function is to automatically begin reciprocating the being, when for example an infant moves around upon waking up. The motion-induced start function may be provided by an angular sensor 30 coupled to the drive or axle 51. The sensor 30 is set to detect the angular position of the axle 51 and to send a signal, which is representative of the angular position of the axle 51 to the controller. If the controller detects—based on the signal received from the sensor—that while the drive 2 is not driven the axle 51 has undergone angular displacement, the controller starts the drive 2 to move the membrane 1. That way the reciprocating motion will be a reaction to the infant making slight a gesture, which indicates that he/she is waking up. The quick reaction to fluctuate the membrane may then prevent the infant from waking up. The angular sensor is not the only option to detect the deviation of the membrane induced by the infant or other being. Other sensoring alternatives include photocells, image recognition through photography or video, load-sensors coupled to the axle of the drive, etc. depicted as sensor 30 mounted on the reciprocating device.

According to a particular embodiment, the device comprises a sound sensor 32, which is configured to detect volumes in the ambient noise exceeding a threshold, such as the sound of an infant crying. Should the sound sensor detect such a sound, the sound sensor is configured to trigger a signal to the controller, which is in turn configured to start a cycle in response to the trigger signal from the sound sensor. The cycle could be timed to last a certain period of time, which can or would not be extended based on the trigger signal coming from the sound sensor 32. Accordingly, the device can be set to continue the reciprocating movement of the membrane until the volume of ambient noise has remained under the threshold level under a certain period of time.

Alternatively or additionally, the device is equipped with a light sensor, which also is send a trigger signal to the controller in response to a change in the amount of ambient light. Such information could be used to stop or start the reciprocating motion of the membrane so as to stop the movement in response to the lights being switched on in a room as an indication that the parent of the infant has entered the room for pacifying or checking in on the infant. The controller may then continue driving membrane after the ambient light has decreased to a level under a certain threshold.

The membrane 1 may be an integral part of a cover (not shown), which is made of fabric and covers the frame the reciprocation device 10. In other words, the cover extends over the membrane 1 and body parts 3, 4, 6, 7 as well as auxiliary components such as the drive 2, controller (not shown) etc. The cover has the function of covering the moving components of the reciprocation device for protecting the user as well as the components from external pieces. The cover includes an opening for the membrane 1, which exposed by the opening in the cover. The membrane may therefore be integrated to the cover by stitching, for example. The cover need not be as breathable as the membrane. However, air permeable fabric does have the benefit of keeping the infant cool and allowing the infant to breathe through the cover and membrane even when sleeping face down. It is preferable that the cover is made from a durable and tight material, preferably fabric, for preventing small particles from entering the machinery of the reciprocation device. While the ends of the membrane contain zippers or similar for attaching to the rod 53 and third longitudinal body part 9, the cover may be formed as a bag for enclosing the reciprocation device and may include a large zipper for enclosing the reciprocation device entirely. The cover is therefore openable and remountable for washing. Dirt and/or liquid deterring and fire resistant substances may be applied to the cover and/or membrane.

The above-described mechanism toggles the tension of the membrane between a loose and tight state for making the center region of the membrane sag and lift in a fluctuating manner, respectively. The tensioning mechanism 5 therefore repeatedly adjusts the tension of the membrane 1 between a loose first tension and a tight second tension such that the second tension is tighter than the first tension. In other words, the tensioning mechanism 5 repeatedly adjusts the sag of the membrane 1 in the third Cartesian dimension X. Another way of examining the loose and tight state of the membrane is to measure the length of the membrane 1. According to the embodiment described with reference to the accompanied FIGURES, the length of the membrane 1 in the tight state corresponds to the span length of the first and second body part 6, 7. The span length is measured as the shortest distance between the longitudinal center axes of the first and second longitudinal member. The length of the membrane 1 in a loose state is longer than the span length measured in the first Cartesian dimension Y. Here it should be understood that the length of the membrane 1 is always measured along the outer surface of the membrane as opposed to measuring a component of extension of the membrane in a specific direction, such as along the first Cartesian dimension Y.

By driving the drive 2 into alternately two opposing directions or revolving it over several turns, the eccentric axle—such as that composed by the axle 51, eccentric member 52 and rod 53—tensions and releases the membrane 1 ever a distance defined by the eccentricity of the eccentric axle. In this regard, the membrane 1 is preferably free to move relative to the first and second longitudinal body part 6, 7 while being fixed to the third longitudinal body part 6. The membrane 1 will experience greater relative movement in respect to the second longitudinal body part 7 than to the first longitudinal body part 6.

There are, however, alternative constructions to cause the fluctuating motion of the membrane 1. According to one embodiment (not shown), the membrane is fixed to at least either longitudinal body part, which has been provided with a drive for rotating the body part. The driven body part may be eccentric or rotationally symmetric, which dictates the manner of rotation. The non-symmetrical cross-section has the benefit of increased friction between the body part and the membrane. Also, it is possible to drive both longitudinal body parts, wherein also the sagging will occur symmetrically in respect to transversal center line of the reciprocation device. The two longitudinal body parts may be driven in opposite directions or similar directions in differenced phases to achieve the desired fluctuating motion.

The embodiments described above have altered the tension of the membrane for creating sag for the non-supported section of the membrane, namely the middle section of the membrane. Without departing from the inventive concept it is also possible to alter the tension of the membrane without adjusting the sag of the membrane at the point, which to be used for supporting the being, such as an infant. The membrane could have an additional supporting structure (not shown), such as a tentering frame, provided to the under surface of the membrane or sawn or otherwise integrated therein. The supporting structure could tighten the membrane over a given area for receiving the being. That way the being could be supported by the membrane extending over the additional supporting structure (or 'tentering frame'), which would maintain its tension over the area, which supports the being. The tension of sections of the membrane outside the additional supporting structure would be adjusted to heighten and lower the area of the membrane extending over the additional supporting structure. Any tensioning mechanism herein described could be used in connection with such additional supporting structure.

According to another embodiment, the longitudinal body parts are enclosed by two lateral covers for keeping the rotatable parts concealed. Exemplary lateral covers are displayed in FIG. 4, for example. Compared to the embodiment shown in FIG. 2, the first and third longitudinal body part 6, 9 are enclosed by a first lateral cover and the second longitudinal body part 7 and the tensioning mechanism 5 are enclosed by a second lateral cover. The transversal body parts connecting the lateral covers transversally may therefore be light, such as hollow profiles, and preferably articulated so as to allow folding of the reciprocation device for transport.

According to yet another embodiment (not shown), a separate drive mechanism is provided below the first and second longitudinal body part 6, 7 to drive at least either first or second body part. The drive mechanism may include a main axle driven by a drive and transmission between the axle and at least either of the first and second longitudinal body part 6, 7. The main axle itself may be eccentric, whereby the transmission may be constructed by simple connecting rods. Alternatively or additionally, at least either first or second body part is eccentric for providing the necessary reciprocation for the end or ends of the membrane.

Figure 3:
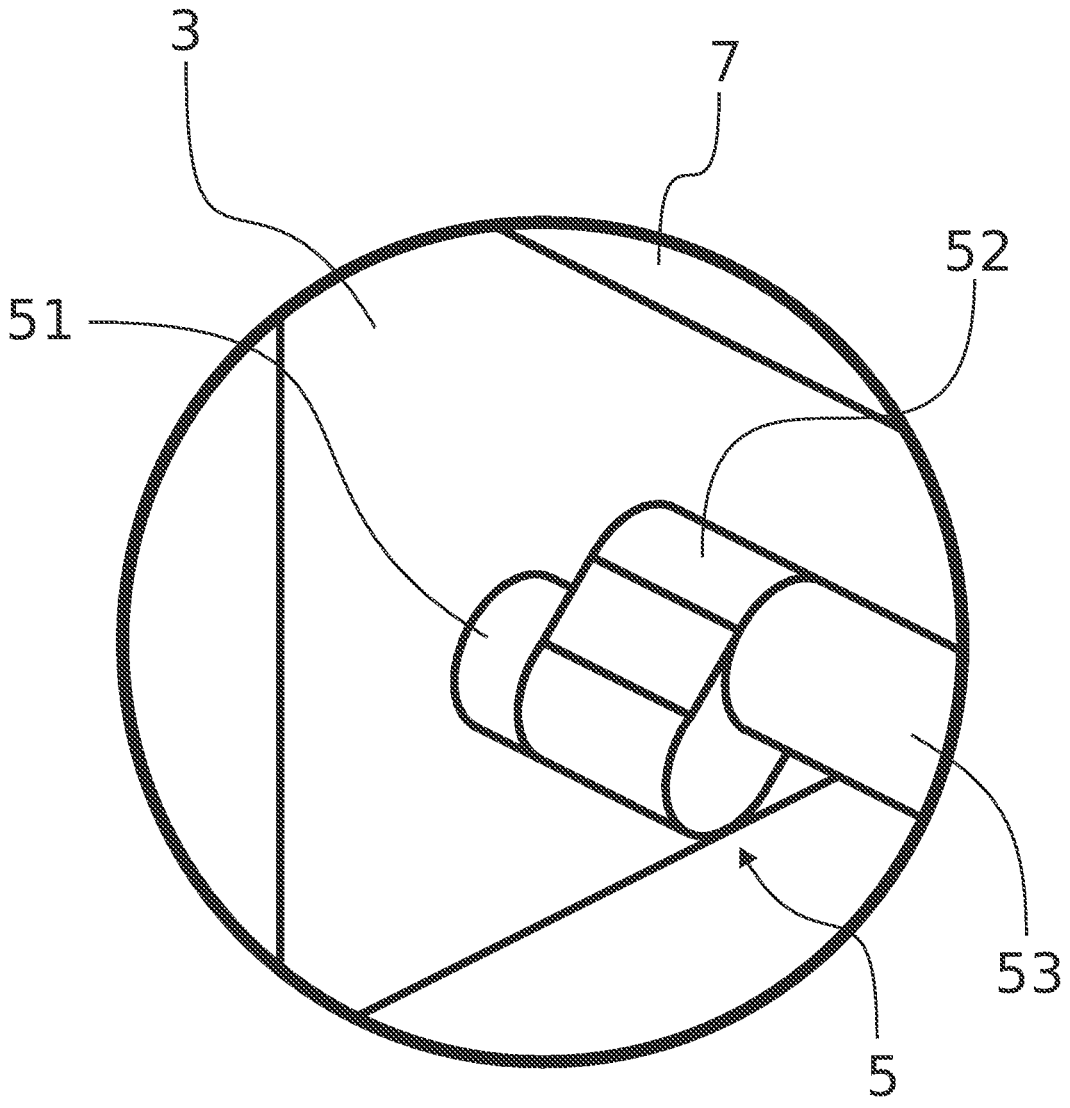
FIG. 3 illustrates a detail view of area A of FIG. 2.

According to a further embodiment (not shown), the tension of the membrane may be adjusted both in the first and second Cartesian dimension Y, Z. The tensioning mechanism may thus include similar constructions provided to the transversal body parts as to the longitudinal body parts shown in the FIGURES. In such an alternative, the transversal body parts may take the form of similar rotatable separate rods as shown in FIG. 3 or the transversal body parts themselves may be rotatable. Then, it may be necessary to provide the reciprocation device with a separate frame or chassis for supporting the two-way tensioning mechanism. That way, the membrane may be loosened and tightened in two dimensions at either or both sides.

Figure 4:
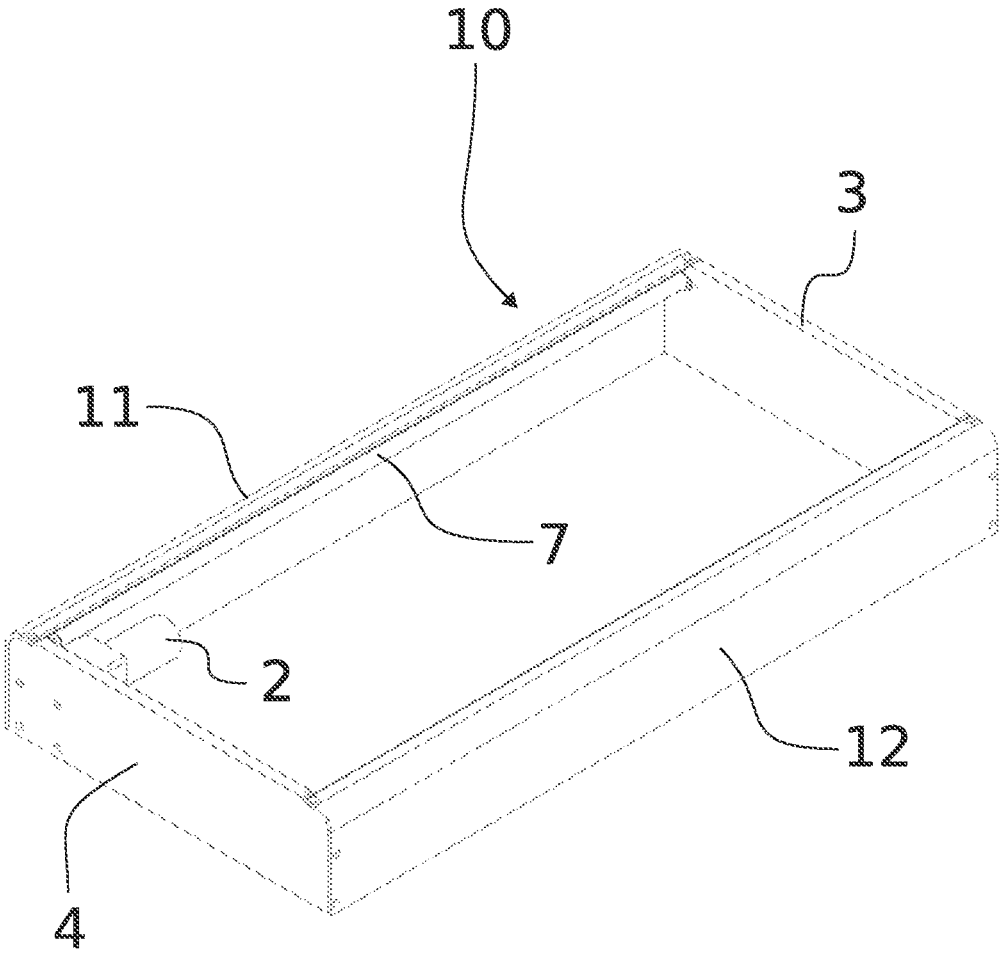
FIG. 4 illustrates an isometric view of a reciprocation device in accordance with at least some other embodiments of the present invention with the membrane removed.
Figure 5:
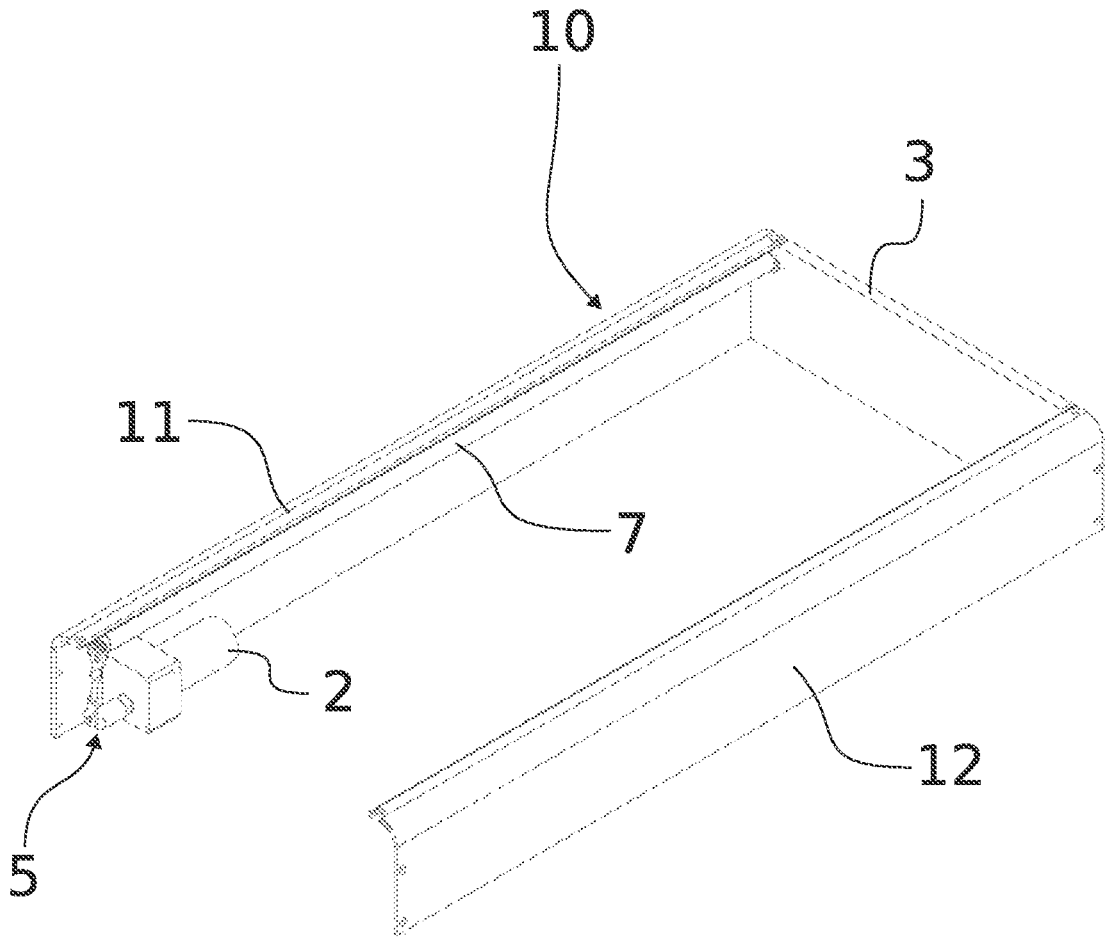
FIG. 5 illustrates the device of FIG. 1 without the second transversal body part for showing the details of the drive.
Figure 6:
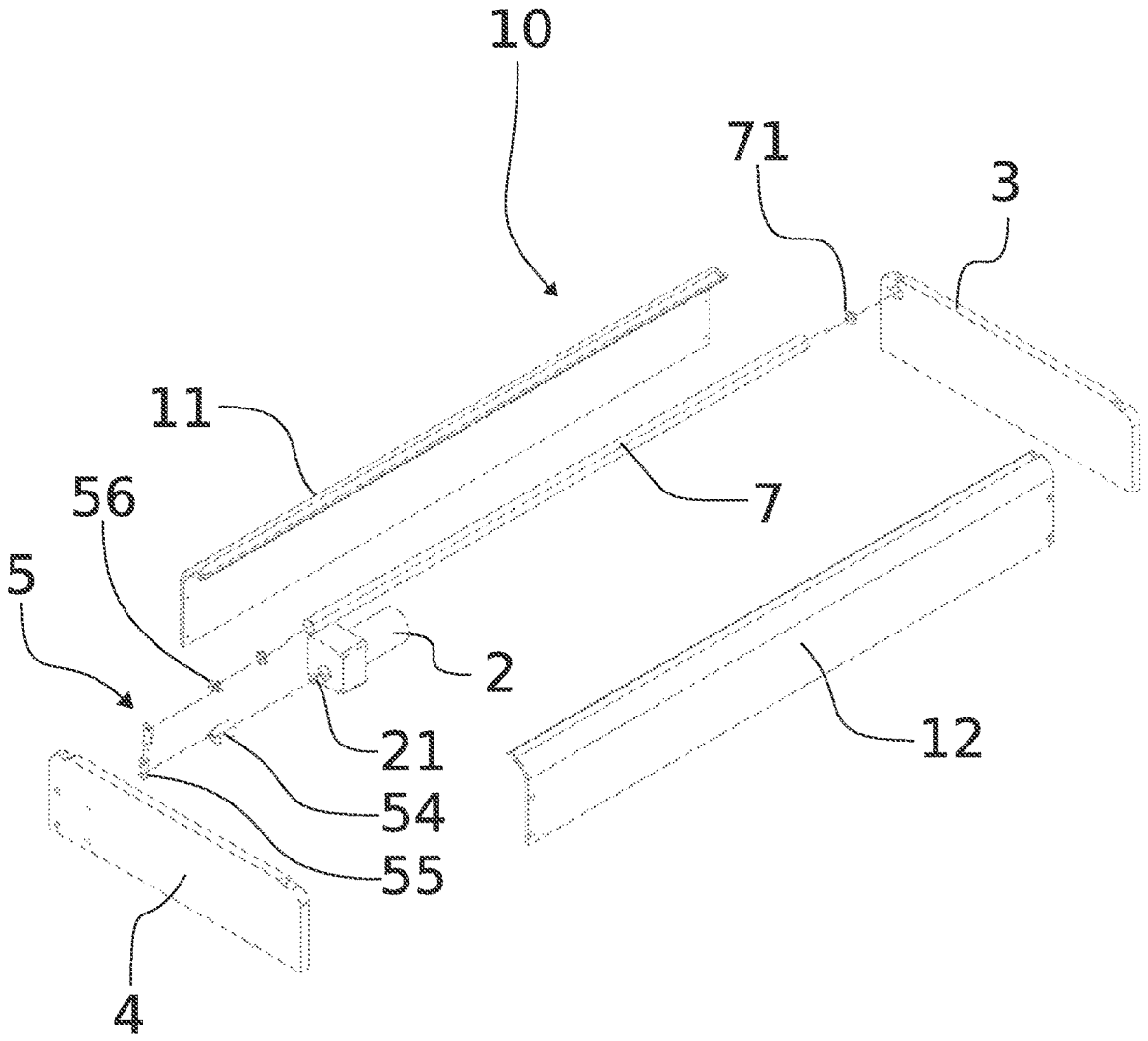
FIG. 6 illustrates an explosion view of the device of FIG. 4.

FIGS. 4 to 6 illustrate another possible way of rotating, i.e. turning about the longitudinal axis to at least some degree, a longitudinal body part. In the illustrated example only the second longitudinal body part 7 is fitted with a drive mechanism, but it would be equally possible to provide both longitudinal body parts 6, 7 with such drive mechanisms or to have the other longitudinal body equipped with a different drive mechanism, such as that illustrated in FIG. 2. Referring back to FIG. 4, which shows that the driven second longitudinal body part 7 as well as the first longitudinal body part 6 are covered by a first and second lateral covers 11, 12, respectively. The lateral covers 11, 12 may be, for example, sheet metal, wood or plastic shaped to cover the side of the device and to extend above the longitudinal body parts so as to prevent access thereto. FIG. 4 shows that the drive 2, such as an electric motor, for the second longitudinal body part 7 is arranged below it and attached to the second transversal body part 4. Obviously, the drive 2 could equally be attached to the first transversal body part 3.

FIG. 5 shows the drive 2 and tensioning mechanism 5 more clearly as the second transversal body part has been omitted from the image. As show, the drive 2 is connected to the second transversal body part 7 by means of a tensioning mechanism 5 taking the form of a rocker mechanism translating the rotation of the output shaft of the drive 2 to rotation of the second transversal body part 7 via a driving rod being eccentrically connected to the rotating parts. FIG. 6 shows this principle in greater detail. As can be seen, the output shaft 21 of the drive 2 is connected to the driving rod 55 through a primary eccentric member 54. The primary eccentric member 54 connects the driving rod 55 to the output shaft 21 such that one end of the driving rod 55 is configured to orbit around the center axis of the output shaft 21 thus creating a first throw in the mechanism. The opposing end of the driving rod 55 is connected to the second longitudinal body part 7 through a secondary eccentric member 56. The secondary eccentric member 56 connects the driving rod 55 to the second longitudinal body part 7 such that the driving rod 55 is configured to orbit around the center axis of the second longitudinal body part 7 thus creating a second throw in the mechanism. This causes the driving rod 55 to reciprocate in a dimension extending between the drive 2 and the second longitudinal body part 7.

Figure 7:
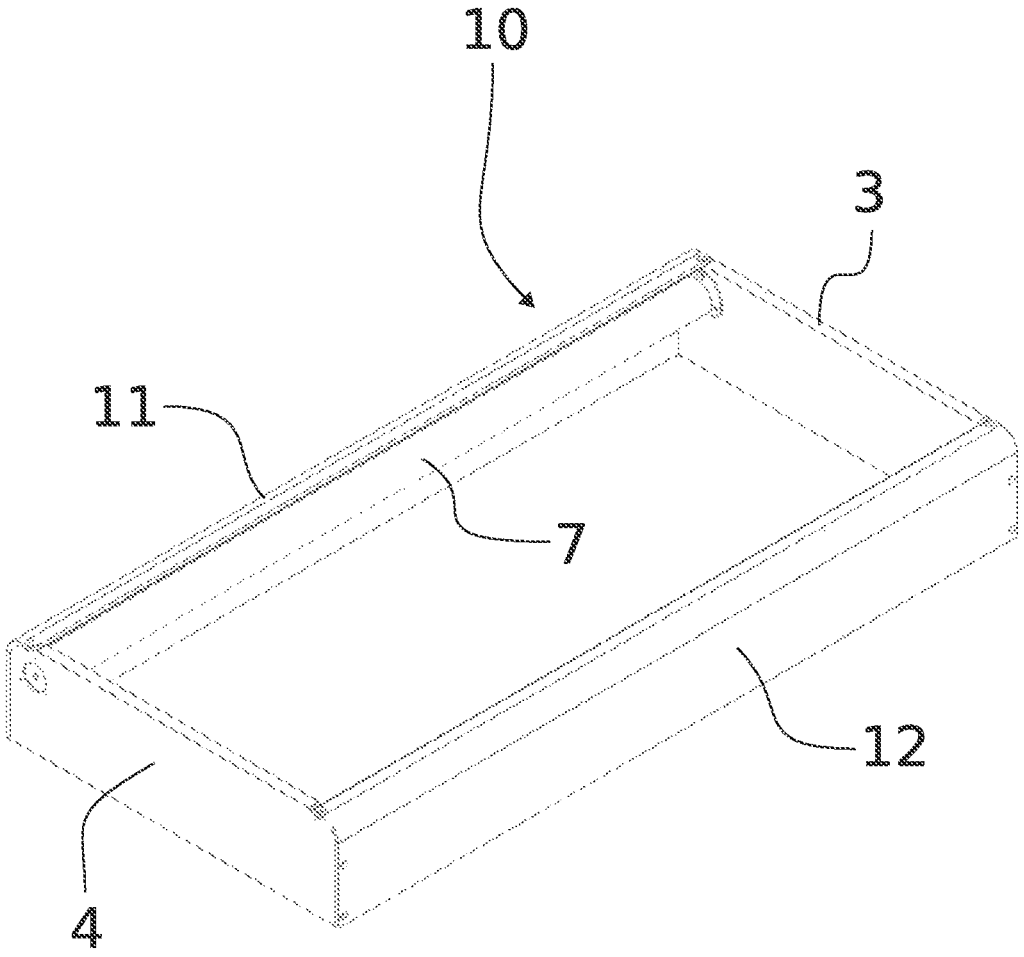
FIG. 7 illustrates an isometric view of a reciprocation device in accordance with at least some other embodiments of the present invention with the membrane removed.
Figure 8:
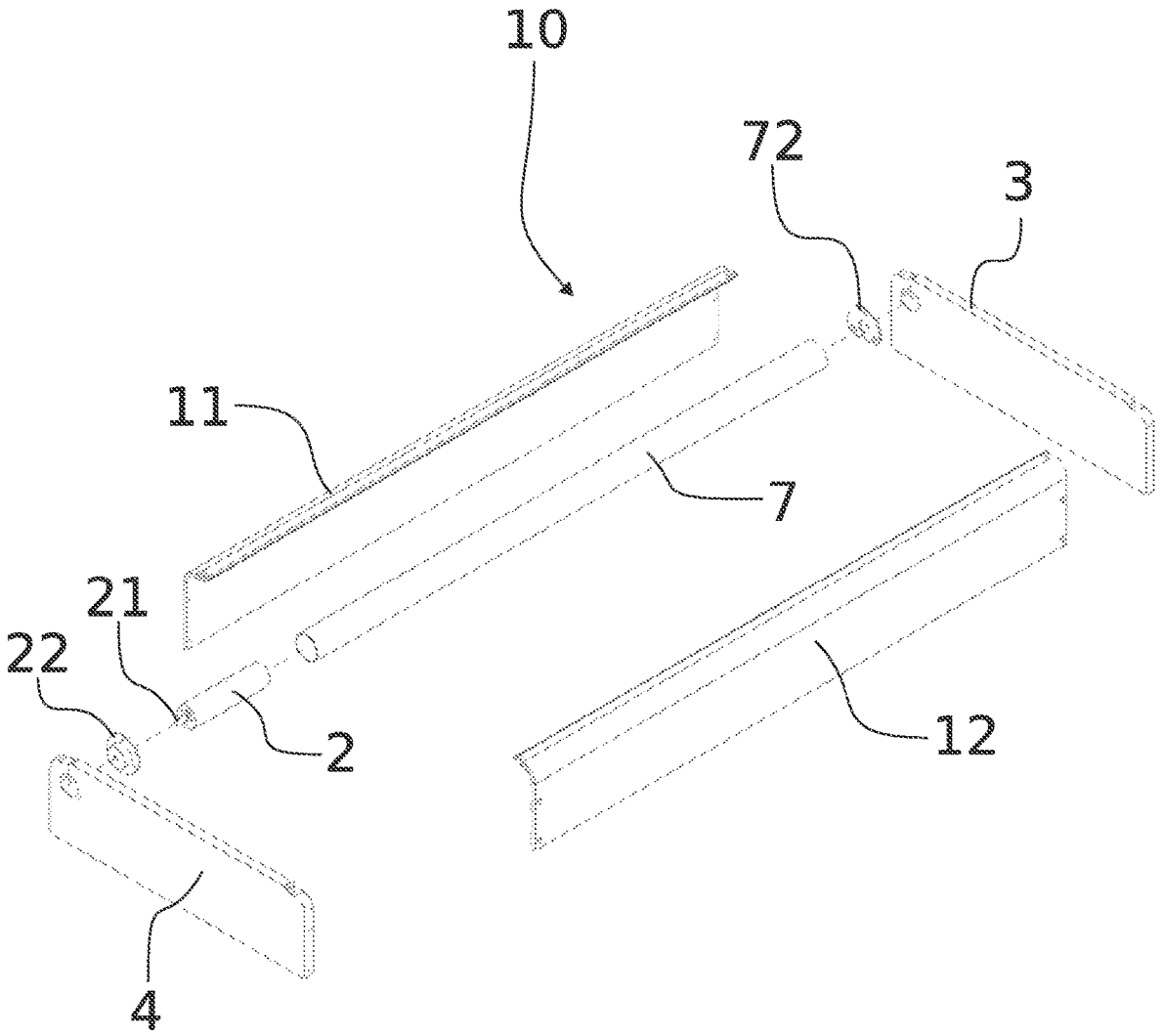
FIG. 8 illustrates an explosion view of the device of FIG. 7.

The tensioning mechanisms shown with reference to FIGS. 1 to 6 all employ a transmission or transfer of mechanical force of some sort. The transmission may also be provided by a simple direct drive as shown in FIGS. 7 and 8. According to the embodiment illustrated therein, the drive 2 is connected directly to the second longitudinal body part 7. In this example, the diameter of the second longitudinal body part 7 is increased so as to fit the drive 2, such as an electric motor, inside the hollow second longitudinal body part 7. In the shown example the drive 2 is fitted to the second longitudinal body part 7 via a friction joint achieved by means of tight tolerances so as to prevent the drive 2 to spin within the receiving cavity of the second longitudinal body part 7. Alternatively, the drive 2 could be angularly fixed to the second longitudinal body part 7 with designated affixers, or inter-engaging shapes between the contact surfaces on the drive and second longitudinal body part (not shown). The output shaft 21 of the drive 2 is fitted into a bracket 22, which in turn is fixed to the second transversal body part 4. Another bracket 72 is provided to the other end of the second longitudinal body part 7, which has an axle (not shown) engaging the bracket 72. Rotation of the second longitudinal body part 7 in respect to the transversal body parts, 3, 4 is allowed by arranging bearings in suitable interfaces between the bracket and the axles/shafts. In the shown example, the output shaft 21 is rotationally fixed to the bracket 22, whereas the axle of the second longitudinal body part 7 can freely rotate in the bearing located in the bracket 72. This arrangement could also be reversed. The drive 2 is controlled by a controller (not shown), which is configured to drive the output shaft 21 in the desired direction over a controlled angular range. For this embodiment drive 2 may be particularly a permanent magnet direct current motor, which provides excellent safety due to low voltage in a compact size. The motor is preferably driven under a closed loop control so as to ascertain the position of the driven longitudinal body part. The position of the driven longitudinal body part may be detected by monitoring the current running through the motor or the torque used by the motor. Alternatively, the drive 2 may be an alternating current motor.

Naturally the direct drive can alternatively or additionally be provided to the second longitudinal body part 6 or to a third or fourth longitudinal body part arranged below the first and second body part (not shown). If the third or fourth longitudinal body parts or both such as those depicted in FIG. 2 would be directly driven, the embodiment would yield the benefit of moving the moving parts as far away as possible from the being lying on the membrane and on the other hand the pre-tension of the membrane could be set on an adjustment mechanism (not shown) fitted to either or both of the first and second longitudinal body parts. The adjustment mechanism would therefore be located high up and thus well accessible to the user. Alternatively, the adjustment mechanism can be provided to the longitudinal body part not being driven and located below the first and second longitudinal body parts.

In both embodiments shown in FIGS. 4 to 8 the membrane (not shown) may be attached to the longitudinal body part by pressing the membrane to the longitudinal body part with an affixer covering the longitudinal body part or by arranging a slit or similar opening to the longitudinal body part, wherein the membrane is threaded through the opening and wherein the movement is stopped by a stopper at one end of the membrane. Such a stopper may be provided simply by a fold in the membrane, which increases the thickness such that the membrane cannot escape completely through the opening. Other connecting options are also available.

The embodiments of the tensioning mechanism explained above all involve a rotatable axle of some sort having or being connected to an eccentric member for providing reciprocation to at least one end of the membrane. It would, however, be possible to adjust the tension of the membrane with other non-rotatable means. According to an alternative embodiment (not shown), the tensioning mechanism employs an actuator provided underneath the membrane and configured to push the loose membrane up along the third Cartesian dimension for tightening and to release the membrane to the loose state by returning to the descended position. The tensioning mechanism could in fact contain several such actuators provided at different locations for a more even effect or for performing a particular sequence for wave-like effects, for example. However, the rotatable eccentric axles described above enjoy the benefit of being lightweight and simple by construction thus improving the robustness of the device.

Regardless of the construction of the tensioning mechanism, the controller of the drive is preferably equipped with a user interface and/or different settings for providing different sequences of fluctuating motion. The user interface may be a remote control by means of a physical terminal or a software interface to be run in a computing terminal, such as a mobile phone. The user interface may alternatively or additionally include a timer.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

REFERENCE SIGNS LIST

| | |
|---|---|
| 1 | membrane, e.g. net |
| 2 | drive, e.g. motor |
| 21 | output shaft |
| 22 | bracket |
| 3 | first transversal body part |
| 4 | second transversal body part |
| 5 | tensioning mechanism |
| 51 | axle |
| 52 | eccentric member |
| 53 | rod |
| 54 | primary eccentric member |
| 55 | driving rod |
| 56 | secondary eccentric member |
| 6 | first longitudinal body part |
| 7 | second longitudinal body part |
| 71 | attachment ring |
| 72 | bracket |
| 9 | third longitudinal body part |
| 10 | device |
| 11 | first lateral cover |
| 12 | first lateral cover |
| X | first Cartesian dimension |
| Y | second Cartesian dimension |
| Z | third Cartesian dimension |

CITATION LIST

Patent Literature

EP 1898753 B1

U.S. Pat. No. 5,107,555 A

The invention claimed is:

1. A reciprocation device comprising a width in a first Cartesian dimension (Y) and a length in a second Cartesian dimension (Z), the reciprocating device comprising:

a single continuous membrane, which is a sheet-like member, configured to support at least one being and arranged to extend along an entirety of the first Cartesian dimension (Y) and along a majority of the second Cartesian dimension (Z) to continuously cover an area and comprising a thickness in the third Cartesian dimension (X), and a tensioning mechanism attached to the membrane and configured to repeatedly adjust the tension of the membrane in at least either first or second Cartesian dimension (Y, Z) to repeatedly adjust a sag of the membrane in the third Cartesian dimension (X) for repeatedly reciprocating the at least one being supported by the membrane, wherein the reciprocation device is constructed as a retro-fit module, which is dimensioned to replace or be placed under the mattress of a crib.

2. The reciprocation device according to claim 1, wherein the tensioning mechanism is configured to repeatedly adjust a tension of the membrane between a loose first tension and a tight second tension, which second tension is tighter than the first tension, or wherein the tensioning mechanism is configured to repeatedly adjust a sag of the membrane in the third Cartesian dimension (X).

3. The reciprocation device according to claim 1, wherein the reciprocation device further comprises:

a first longitudinal body part extending in the second Cartesian dimension (Z), a second longitudinal body part extending substantially parallel to and being distanced from the first longitudinal body part at a span length in the first Cartesian dimension (Y), and wherein the membrane spans between and supported by the first and second longitudinal body part over the span length.

4. The reciprocation device according to claim 3, wherein:

the span length corresponds to the length of the membrane in a tight state measured in the first Cartesian dimension (Y) and wherein the length of the membrane in a loose state is longer than the span length measured in the first Cartesian dimension (Y), and the tensioning mechanism is configured to repeatedly adjust the length of the membrane along the first Cartesian dimension (Y) between a first length and a second length, which second length is longer than the first length.

5. The reciprocation device according to claim 1, wherein the length of the membrane measured in the first Cartesian dimension (Y) is 10 percent longer in the loose state is than in the tight state or the amplitude of the fluctuating motion measured from the center of the membrane is between 10 and 150 mm or both.

6. The reciprocation device according to claim 1, wherein the tensioning mechanism includes a rotatable member connected to the membrane for repeatedly adjusting the tension of the membrane.

7. The reciprocation device according to claim 6, wherein one end of the membrane is connected to the tensioning mechanism and another end of the membrane is secured in respect to a first longitudinal body part and configured to move in respect to a second longitudinal body part during transitions between the states of the membrane.

8. The reciprocation device according to claim 7, further comprising:

a third longitudinal body part deviated from the second longitudinal body part in the third Cartesian dimension (X), and said another end of the membrane is fixed to the third longitudinal body part so as to be supported by the first longitudinal body part.

9. The reciprocation device according to claim 6, wherein the tensioning mechanism includes:

an axle, and a drive which is configured to rotate the axle for toggling the membrane between a loose and tight state.

10. The reciprocation device according to claim 9, wherein the tensioning mechanism further includes an eccentric member for providing a radial deviation from the axle for providing a reciprocity at one end of the membrane so as to repeatedly adjust the tension of the membrane between the loose and tight state.

11. The reciprocation device according to claim 6, wherein at least either the first or second longitudinal body part acts as the tensioning mechanism by being configured to be rotated.

12. The reciprocation device according to claim 11, wherein at least either of the first and second longitudinal body part has a rotationally non-symmetrical cross-section for gripping the membrane.

13. The reciprocation device according to claim 11, wherein below the first and second longitudinal body part is arranged a drive mechanism including a main axle and transmission between the axle and at least either of the first and second longitudinal body part.

14. The reciprocation device according to claim 11, wherein the drive is fixed to the at least either first or second longitudinal body part so as to provide direct drive.

15. The reciprocation device according to claim 14, wherein the at least either first or second longitudinal body part have an inner cavity into which the drive is fitted.

16. The reciprocation device according to claim 1, further comprising:

a first transversal body part connecting a first and second longitudinal body part at one end of the reciprocation device, a second transversal body part connecting the first and second longitudinal body part at another end of the reciprocation device, and wherein the first and second transversal body part as well as the first and second longitudinal body part form a frame of the reciprocation device for acting as a mounting point for accessories including a drive.

17. The reciprocation device according to claim 16 further comprising: a cover comprising a fabric and configured and arranged to cover the frame of the reciprocation device, said cover comprising an opening for the membrane, and wherein the membrane is configured to be integrated to the cover and arranged to be exposed by the opening in the cover.

18. The reciprocation device according to claim 9, wherein:

the tensioning mechanism includes a sensor which is configured to sense deviations in the tension of the membrane including those prompted by the being, and a controller configured to:

detect that the drive is not-driven, determine from the signal received from the sensor deviations in the tension of the membrane including those prompted by the being, and to start the non-driven drive upon receiving a signal from the sensor indicating deviated tension of the membrane.

19. The reciprocation device according to claim 18, wherein the sensor is configured to:

sense the angular position of the axle, and to send a signal representing the angular position of the axle to the controller.

20. The reciprocation device according to claim 9 further comprising: a sound sensor which is configured to measure volume of ambient noise and to trigger a signal, when a measured volume exceeds a predetermined threshold value, and a controller which is connected to the sound sensor so as to receive a signal prompted by excess ambient noise and to start the drive in response to the signal.

21. A crib, comprising a reciprocation device having:

a membrane which is configured to support at least one being and which membrane extends along a first Cartesian dimension (Y) and a second Cartesian dimension (Z) to cover an area and has a thickness in the third Cartesian dimension (X), and a tensioning mechanism attached to the membrane and configured to repeatedly adjust the tension of the membrane in at least either first or second Cartesian dimension (Y, Z) for repeatedly reciprocating the at least one being supported by the membrane.

22. A reciprocation device comprising a width in a first Cartesian dimension (Y) and a length in a second Cartesian dimension (Z), the reciprocating device comprising:

a single continuous membrane, which is a sheet-like member, configured to support at least one being and arranged to extend along an entirety of the first Cartesian dimension (Y) and along a majority of the second Cartesian dimension (Z) to continuously cover an area and comprising a thickness in the third Cartesian dimension (X), a tensioning mechanism attached to the membrane and configured to repeatedly adjust the tension of the membrane in at least either first or second Cartesian dimension (Y, Z) to repeatedly adjust a sag of the membrane in the third Cartesian dimension (X) for repeatedly reciprocating the at least one being supported by the membrane, wherein the reciprocation device is constructed as a retro-fit module, which is dimensioned to replace or be placed under the mattress of a crib, a first transversal body part connecting a first and second longitudinal body part at one end of the reciprocation device, a second transversal body part connecting the first and second longitudinal body part at another end of the reciprocation device, and a cover comprising a fabric and configured and arranged to cover a frame of the reciprocation device, said cover comprising an opening for the membrane, and wherein the membrane is configured to be integrated to the cover and arranged to be exposed by the opening in the cover.

23. A reciprocation device comprising a width in a first Cartesian dimension (Y) and a length in a second Cartesian dimension (Z), the reciprocating device comprising:

a single continuous membrane, which is a sheet-like member, configured to support at least one being and arranged to extend along an entirety of the first Cartesian dimension (Y) and along a majority of the second Cartesian dimension (Z) to continuously cover an area and comprising a thickness in the third Cartesian dimension (X), a tensioning mechanism attached to the membrane and configured to repeatedly adjust the tension of the membrane in at least either first or second Cartesian dimension (Y, Z) to repeatedly adjust a sag of the membrane in the third Cartesian dimension (X) for repeatedly reciprocating the at least one being supported by the membrane, wherein the reciprocation device is constructed as a retro-fit module, which is dimensioned to replace or be placed under the mattress of a crib, a first transversal body part connecting a first and second longitudinal body part at one end of the reciprocation device, a second transversal body part connecting the first and second longitudinal body part at another end of the reciprocation device, a cover comprising a fabric and configured and arranged to cover a frame of the reciprocation device, said cover comprising an opening for the membrane, and wherein the membrane is configured to be integrated to the cover and arranged to be exposed by the opening in the cover, and wherein the first and second transversal body part as well as the first and second longitudinal body part form the frame of the reciprocation device for acting as a mounting point for accessories including a drive.

24. The reciprocating device according to claim 1, wherein the single membrane comprises a fabric configured to be permeable to air.

* * * * *